US005553833A

United States Patent [19]

Bohen

[11] Patent Number: 5,553,833

[45] Date of Patent: Sep. 10, 1996

[54] SAFETY BARRIER MOUNT

[75] Inventor: F. Russell Bohen, Palm Harbor, Fla.

[73] Assignee: Protect- A- Child Pool Fence Systems, Inc., Pompano Beach, Fla.

[21] Appl. No.: 176,223

[22] Filed: Jan. 3, 1994

[51] Int. Cl.[6] ..... E04H 17/22

[52] U.S. Cl. ..... 256/65; 256/59; 256/19

[58] Field of Search ..... 256/19, 32, 31, 256/59, 65, 66, DIG. 2, DIG. 5

[56] References Cited

U.S. PATENT DOCUMENTS

| | | | |
|---|---|---|---|
| 994,742 | 6/1911 | Gregory | 256/19 X |
| 3,111,303 | 11/1963 | Olson | 256/19 |
| 4,380,327 | 4/1983 | Fish | 256/24 |
| 4,610,432 | 9/1986 | Lewis et al. | 256/65 |
| 5,152,508 | 10/1992 | Fish | 256/24 |
| 5,161,784 | 11/1992 | Sader | 256/19 X |
| 5,165,663 | 11/1992 | Wells | 256/19 |
| 5,257,874 | 11/1993 | Kato et al. | 256/19 X |

*Primary Examiner*—Anthony Knight
*Attorney, Agent, or Firm*—David Kiewit

[57] ABSTRACT

Lightweight, easily handled safety barriers are commonly erected around swimming pools to save small children from accidental drowning. Prior art barriers are made of a number of flexible panels attached to poles that are inserted into partially sleeved receptacles. The degree of protection offered by such a fence is improved by the provision of interlocking poles and receptacles. In a preferred embodiment, each pole has a key at its lower end and each sleeve has a keyway through which a corresponding pole's key can be inserted. When the barrier is erected each panel is drawn taut, which rotates all but one pole of a section into a locked orientation. The remaining pole, which is at an end of the section, is rotated into a locked orientation by latching it to an end pole of an adjacent section of the barrier.

2 Claims, 4 Drawing Sheets

SAFETY BARRIER MOUNT

BACKGROUND OF THE INVENTION

The present invention provides an improvement to lightweight, easily handled safety barriers. Barriers of this sort are commonly erected around swimming pools to save small children from accidental drowning. A description of such a barrier is found in Fish's U.S. Pat. No. 4,380,327, the disclosure of which is herein incorporated by reference.

Prior art swimming pool safety barriers are commonly stretched-panel fences with flexible, lightweight panels (e.g., of woven nylon mesh with top and bottom reinforcing ropes) clamped to poles slid into mounting receptacles. The receptacles (which are commonly made by pounding a cylindrical plastic sleeve into a nominally cylindrical hole drilled in a concrete pool deck) are installed slightly further apart than the nominal distance between poles. Thus, a panel must be stretched slightly to insert its poles into their receptacles. It is also common practice to make tilted receptacles at curved portions of the barrier. A pole inserted into a tilted receptacle initially slants outward from the swimming pool, but deforms slightly into a more upright alignment when the panels disposed on either side of it are stretched.

Pool safety barriers erected to keep unsupervised toddlers out of the pool must be easily removed, or opened, so that an adult can use the pool with a minimum of inconvenience. This requirement dictates choices of panel strength and weight, of pole rigidity, etc., for prior art fencing that allow an adult to easily grasp a pole, stretch an attached panel, and lift the pole from its mounting receptacle. Prior art fences are conventionally made in sections two to three meters in length. This allows a pool user to remove, fold, carry, and stow a section of a convenient size.

A shortcoming of prior art barriers is that it may be so easy to lift a pole from a receptacle that a small child can defeat the safety barrier by either opening the gate area or by crawling under the fence. Although a too easily lifted pole may be a consequence of adjacent receptacles being installed too close together, many such situations are unavoidable in prior art fences. For example, poles installed in tilted receptacles at a corner of a pool are usually very difficult to pull out unless one first relaxes the tension on the adjacent panels. Poles that are in the middle of a long straight run of fencing (e.g., as will be encountered along the long edge of a rectangular pool), on the other hand, are much easier to remove.

SUMMARY OF THE INVENTION

It is an object of the invention to provide a safer swimming pool barrier, particularly for a pool that requires a long, straight run of fencing.

It is a specific object of the invention to provide a flexible-panel fence in which a supporting pole cannot be removed from its receptacle as long as the adjacent panels are subject to a tensile stress above a predetermined minimum value.

It is a further object of the invention to provide method and apparatus for locking a removable fence pole into a mounting receptacle.

It is yet a further object of the invention to provide a sectional flexible-panel fence in which an end pole of a fence section is attached to an end pole of an adjoining section with a latching means so as to keep the end poles of each section reliably locked into their respective receptacles, and to maintain a constant tension along the entire fence.

DETAILED DESCRIPTION

Figure 1:
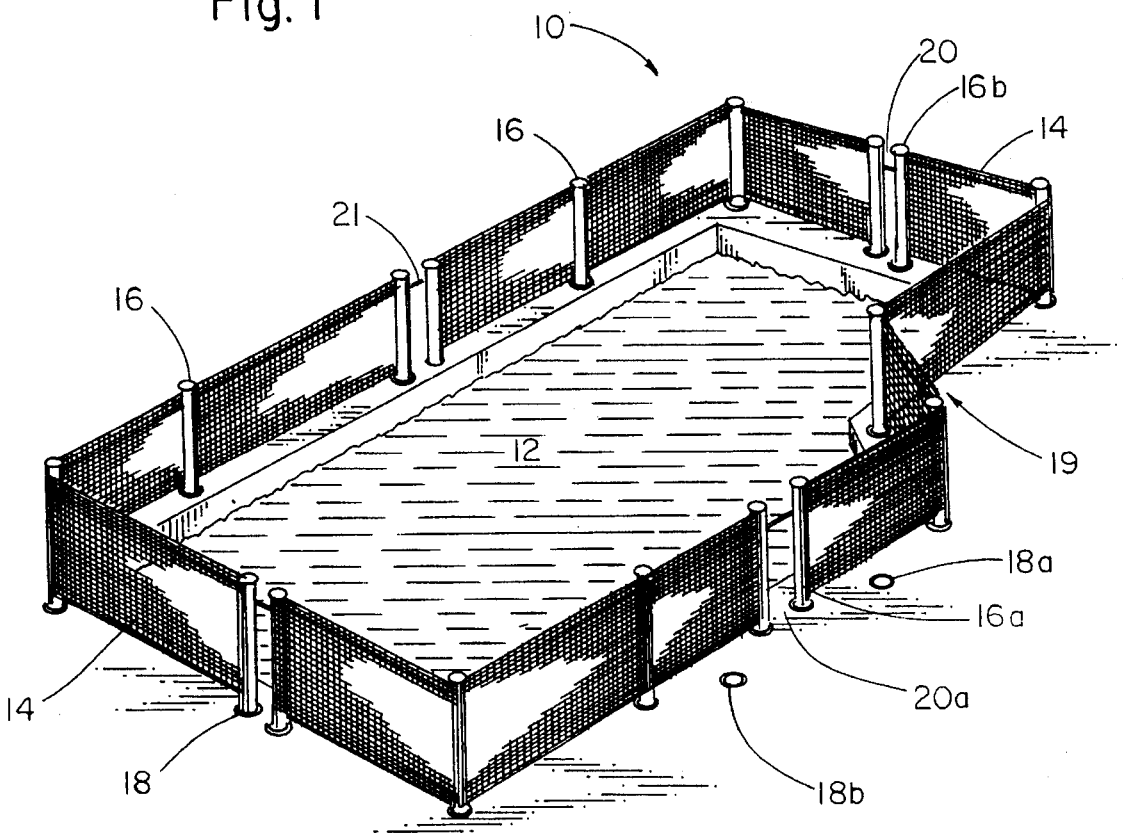
FIG. 1 of the drawing is a perspective view of a sectional safety barrier surrounding a swimming pool.

Turning initially to FIG. 1 of the drawing, one finds a perspective view of a flexible-panel fence 10 surrounding a swimming pool 12. The fence 10 includes a number of flexible panels 14, each of which is stretched between two poles 16 inserted in receptacles 18. Each section 19 of the fence 10 terminates with gate poles **16*a*, 16*b* that are used to form gates 20 where two closely spaced gate poles 16*a*, 16*b* have a gap between them that is too small to allow a child to pass through. Gate poles 16*a*, 16*b* differ from other poles primarily in having latch (or latch and handle) hardware fastened to their above-ground portions, as will be subsequently discussed. At each gate 20 a latch 21 is used to connect two sections 19. Although the sectional design of the fence 10 provides a plurality of gates 20, a single user-gate 20*a* is commonly designated by adding a pair of additional lay-back receptacles 18*a*, 18*b* to hold the gate poles 16*a*, 16*b*** when the barrier is opened and the pool is in use.

In order for the fence 10 to effectively exclude small children from the pool 12, the flexible panels 14 are installed so that a child cannot lift the bottom of a panel 14 and crawl under the fence 10. It is well known to do this by using a panel with an inherently elastic structure (e.g., the combination of a woven fabric with top and bottom reinforcing ropes shown by Fish in U.S. Pat. No. 4,380,327), but the feature may also be provided by using a sufficiently deformable material (e.g., an extruded elastomeric sheet, or a sheet with a pierced, non-woven mesh) for the panel 14. In prior art construction of a stretched-panel barrier 10, the poles are placed about 0.7–0.9 m apart and slightly shorter panels 14 are stretched between them. It will be appreciated that a pole in a long straight run of fence will experience nearly equal and diametrically oppositely directed forces from the two panels attached to either side of it. Such a pole will be relatively easy to pull upward. A pole at a bend in the barrier on the other hand, will experience panel tensions that are not diametrically opposed and will thus be held in a binding relation with its receptacle.

Figure 2:
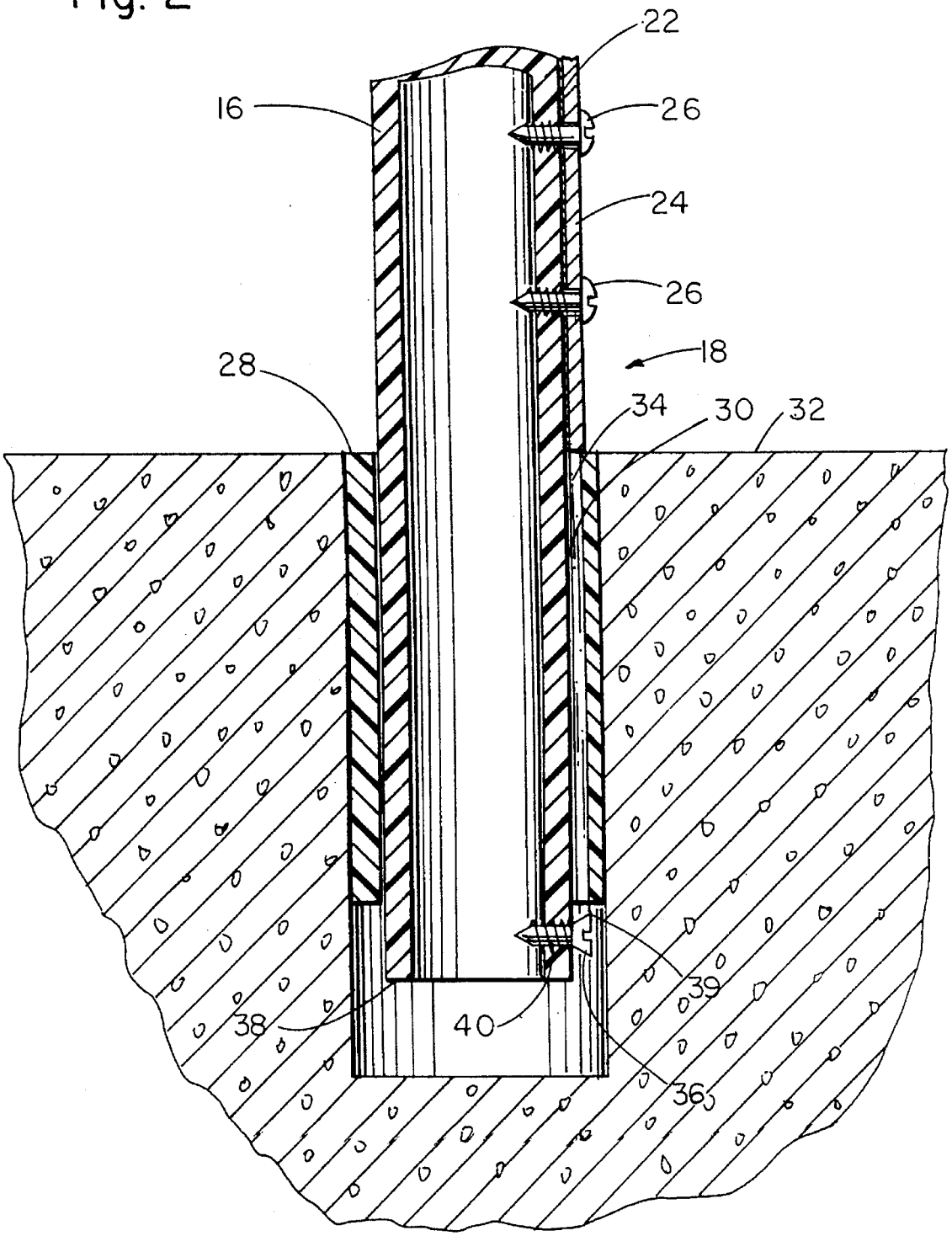
FIG. 2 of the drawing is a vertical cross-sectional view of a pole and receptacle of the invention, showing the pole in an unlocked position.
Figure 3:
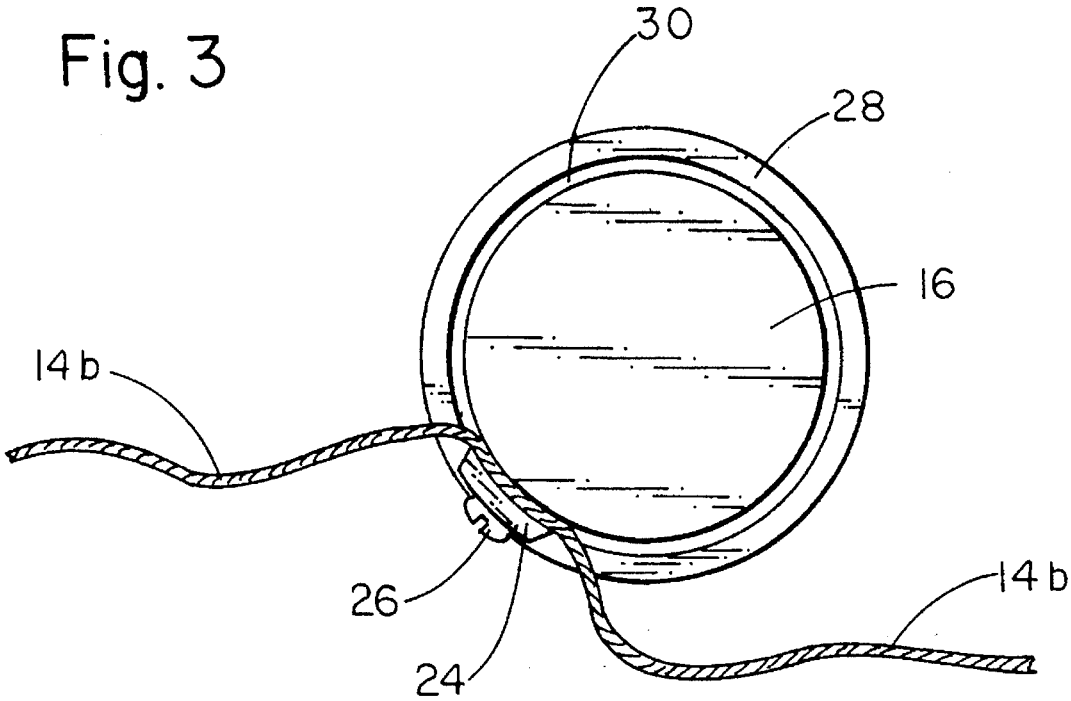
FIG. 3 of the drawing is a top plan view of a pole and receptacle of the invention, showing the pole in an unlocked position with a slack adjacent panel.
Figure 4:
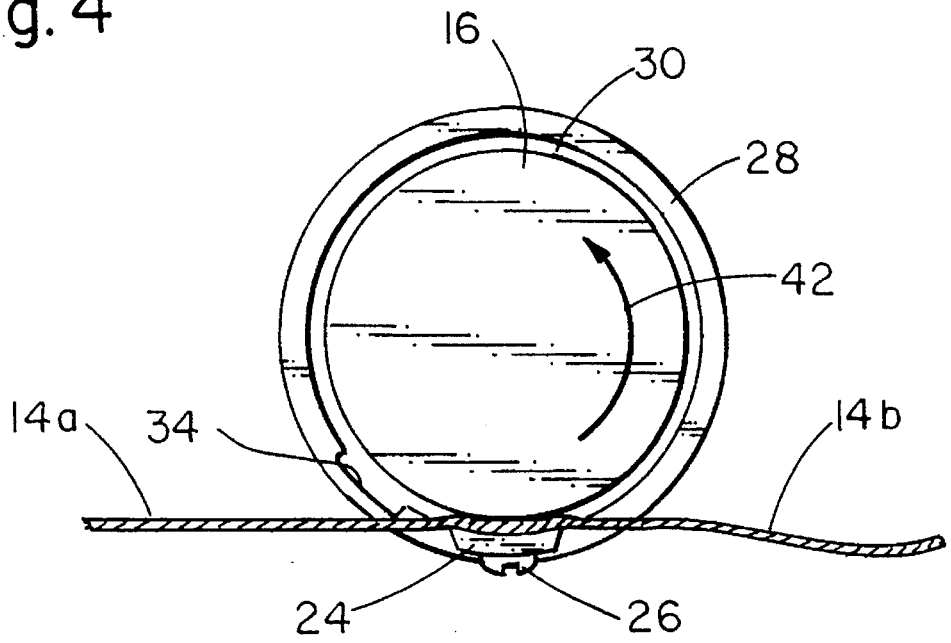
FIG. 4 of the drawing is a top plan view of a pole and receptacle of the invention, showing the pole in a locked position with taut adjacent panels.

A preferred way to lock the poles into their receptacles so that a simple pull along the axis of the elongate cylindrical pole does not remove it from its receptacle is shown in greater detail in FIGS. 2–4 of the drawing. Turning initially to FIG. 2, one finds a pole 16 (which is drawn as a hollow tube, but which may have other geometries such as a solid rod, or a cored tube) has fence panel material 22 clamped to it by a clamping member 24 held to the pole 16 by screws 26, as is known from the prior art. The pole 16 is inserted into a receptacle 18 made by inserting a polymeric sleeve 28 into the upper part of a hole 30 bored into a concrete pool deck 32 (The use of a sleeve 28 with a well-controlled inner diameter inserted into an imprecisely drilled hole 30 is well known).

An improvement over the prior art is offered by providing a vertical keyway 34 and a key element 36 near the bottom end 38 of a pole 16. It will be understood that a variety of methods of making the keyway (e.g., by injection molding a receptacle, or by cutting the sleeve 28 from a longer extruded keywayed pipe) are known to the art. The sleeve 28, as shown in FIG. 2, has a length less than the depth of the hole 30, and has a keyway 34 with a depth (measured along a radius of the hole 30) selected so that the radial extent of the keyway is greater than the radial extent of the key or knob 36. Thus, the key element 36 can be inserted through the keyway 34 to a point beyond the end of the sleeve 28, as is shown in FIG. 2. When the keyed end of the pole 16 protrudes beyond the bottom of the sleeve 28, the pole can be rotated about its axis. In order both to keep the pole 16 from binding on the bottom of the hole 30, and to provide a uniform and aesthetically pleasing fence height above the deck 32, the hole 30 is bored deeply enough that the depth to which the pole 16 can be inserted into the hole 30 is limited by the clamp. 24 hitting the top of the sleeve 28.

The preferred key or knob 36 is the head of a conventional flat head screw 40, although round-headed screws, rivets, or integrally molded portions of the pole 16 may also be used. It has been found that the sharp edge 39 of a flat-headed screw 40 effectively 'bites' into the bottom of the deformable sleeve 28 if one tries to improperly pull the pole 16 from the hole 30 without first rotating the pole 16 to align the key 36 and keyway 34. A smoother key 36 (e.g., a round-headed screw) can sometimes be pulled part way into the sleeve 28 if the pole 16 is tilted with respect to the axis of the sleeve 28—this effectively jams the pole and sleeve together and requires replacement of the affected sleeve 28.

FIG. 3 of the drawing presents a top view of the situation shown in cross-section in FIG. 2. In the preferred case shown in FIG. 3, the fence panel 14*a* is pulled nearly taut when the keyed pole 16 (the key 36 is hidden below the clamp 24) is inserted into the sleeve 28. After insertion, the pole 16 is rotated (e.g., through an angle of between 45° and 90°, as indicated by the arrow 42 in FIG. 4) into a locked position when the fence panel 14*b* on the other side of the pole 16 is pulled taut to insert the next pole 16 in the next socket 18.

Although the preferred apparatus of the invention uses the combination of a keyed pole and a sleeve with an integrally formed keyway, it will be understood that a variety of other rotary locking mechanisms (e.g., a threaded pole with jamming threads, or a bayonet-type fastener with a non-corrodible spring at the base of the receptacle to hold a locking member in place) are known to the art. Moreover, although the pole insertion sequence shown in FIGS. 3 and 4 of the drawing implies that receptacles 18 are placed at distances such that panel tension is set by rotating a pole about its axis, it will be understood that this rotation may be combined with prior art translational stretching to ensure that a panel 14 is properly taut. It will also be understood that the preferred sleeve with an integrally formed keyway 34 could be replaced by a sleeve with another rotary locking element (e.g., a threaded sleeve), or one could use an unsleeved receptacle formed to incorporate a rotary locking feature (e.g., a preformed mounting element can be built into a reinforcing "dirt spike" for insertion into the earth through a hole drilled in a wooden deck that was too thin to sustain the fence's forces.).

Figure 5:
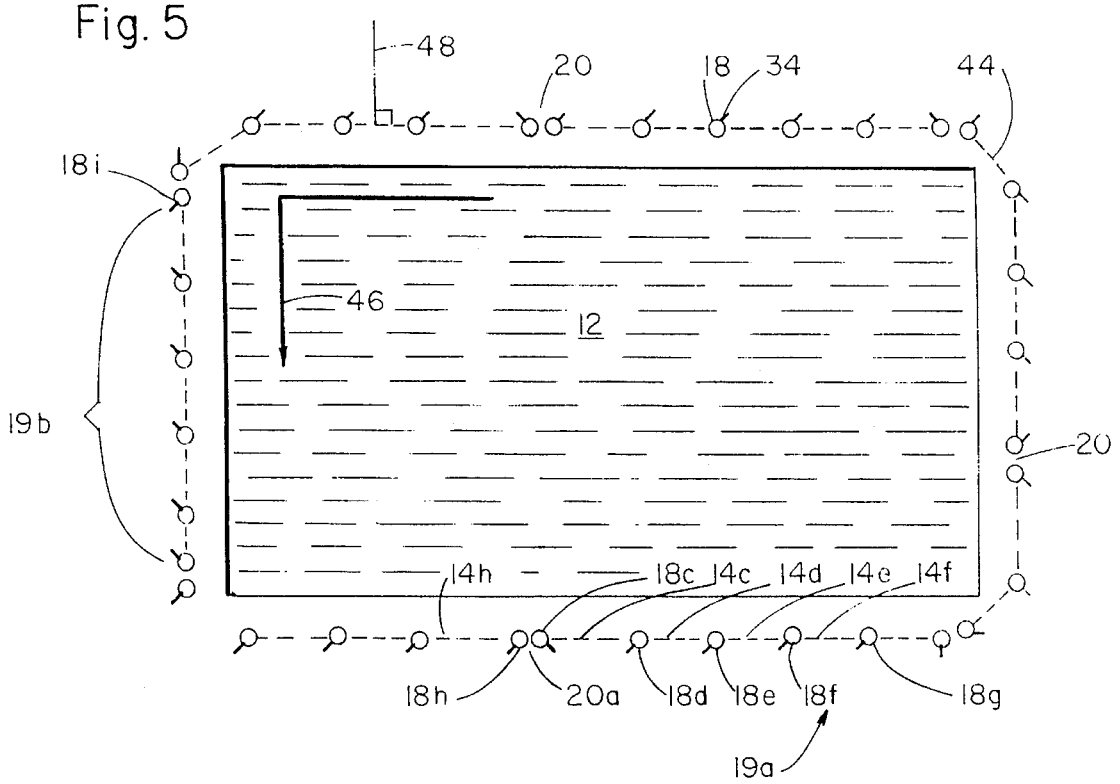
FIG. 5 of the drawing is a schematic plan view of a plurality of receptacles of the invention, showing the keyway alignment varied along sections of the fence.

Although most of the receptacles in a fence of the invention are installed so that the act of tightening an associated fence panel locks an inserted pole in position, this is not the case with gate poles 16*a*, 16*b*, as will now be described with reference to FIG. 5 and 6 of the drawing. Turning now to FIG. 5 one finds a schematic illustration of preferred settings of keyways 34 of receptacles 18 for a multi-section fence 10 (shown in phantom) around a pool 12. Generally speaking, all but one of the receptacles used for a single straight section 19*b* of the barrier have an angular orientation about a vertical axis such that their keyways are aligned in the same direction. The one exception for each straight section 19*b* is a counter-oriented receptacle 18*i* intended for the insertion of a gate pole that is to be held in a locked position by means of a separate latch 21. As can be seen from FIG. 5, at a corner 44 of the fence line the alignment of the keyways 34 rotates by the same number of degrees of arc as are found in the corner of the pool.

Thus, a four-panel, five-pole section 19*a* of the fence 10 could be erected in the receptacles 18*c*–18*g* shown in FIG. 5 by starting at the user-gate 20*a*, inserting a gate pole 16*a* into receptacle 18*c*, and then sequentially inserting the other poles 16 of the section 19*a* respectively into receptacles 18*d*–18*g*—i.e., by proceeding around the pool 12 in the direction indicated by the arrow 46. As previously discussed, the poles in receptacles 18*d*–18*f* would be locked into position when the associated panels 14*d*–14*f* were pulled taut. Panel tension, however, would not hold the gate poles in the two end receptacles 18*c*, 18*g* of the section 19*a* in a locked rotational attitude.

Figure 6:
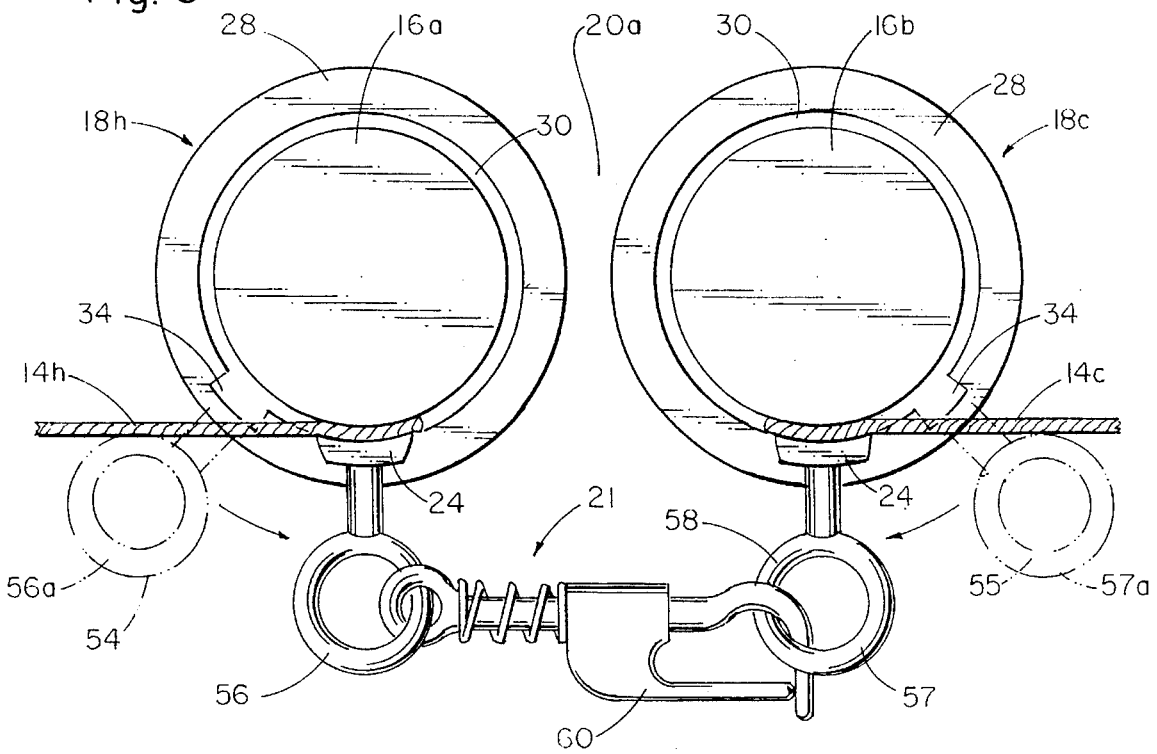
FIG. 6 of the drawing is an elevational top view of a latching mechanism attaching two gate poles into a mutually locked configuration.

P Turning now to FIG. 6 of the drawing, one finds a separate latch 21 used to secure gate poles 16*a*, 16*b* in their receptacles so that they cannot be easily withdrawn. As shown in FIG. 5, a gate 20 is provided at both ends of each section 19 of the barrier 10. In a preferred case shown in FIG. 5, all the normally oriented receptacles have their keyways oriented at an angle θ with respect to a local perpendicular 48 to the fence 10, while counter-oriented receptacles (e.g., 18*c* and 18*i*) have keyways rotated an angle of −θ from the perpendicular 48.

P At the gate 20*a* one inserts gate poles 16*a*, 16*b* into receptacles 18*c*, 18*h*. The gate poles 16*a*, 16*b* differ from other poles in that they include handle elements 54, 55 (which may be eyelets 56, 57, or which may be separate graspable members) that a user can grasp and squeeze together, thus rotating the gate poles 16*a*, 16*b* into a lockable orientation and simultaneously tensing the tops of the adjacent panels (in FIG. 6 the initially inserted positions of the eyelets are shown in phantom with reference numerals 56*a*, 57*a*). After rotating the gate poles 16*a*, 16*b* into a lockable position, the user can latch the two poles into the desired rotationally locked attitude (e.g., by using a hook 58 that mates with the eyelets 56, 57). In a preferred embodiment, the latch is a well-known hook-and-eye that has a spring-loaded tang 60 (with a spring that is too stiff to be operated by a small child) holding the hook in position. It will be understood to those skilled in the art that a wide variety of latching mechanisms can be used to hold gate poles 16*a*, 16*b* in a predetermined rotational orientation so that they are locked against being withdrawn from their respective receptacles by a simple vertical tug.

Although the arrangement shown in FIG. 5 is preferred, enclosures with varying number of gates, incomplete enclosures (e.g., where a fixed building wall near a pool is used as part of the security barrier) etc., can be put up with differing keyway alignments, some of which may also require a variation in receptacle-to-receptacle spacing to ensure that enough tension is maintained in one or more of the panels so that adjacent keyed poles are rotated and held in a locked position.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is desired to be claimed by Letters Patent is:

1. In a fence comprising two or more multi-panel sections, each of the sections extending intermediate two gate poles, each of the sections comprising a plurality of flexible panels, each of the panels attached intermediate a pair of poles removably inserted respectively into corresponding ones of a plurality of receptacles, an improvement comprising:

a key element adjacent the bottom of each of the poles;

a keyway formed in each of the receptacles, the keyway of the receptacle into which the first gate pole of the first section is inserted having a first rotational orientation relative to a line perpendicular to the fence at that receptacle, the keyway of each of the remaining receptacles into which the corresponding poles of the first section are inserted counter-oriented with respect to the keyway in which the first gate pole of the first section is inserted; and a latch connecting the first gate pole of the first section to one of the gate poles of the second section, whereby a uniform panel tension is maintained in the panels of the first section.

2. A fence of claim 1 wherein the angle between the first rotational orientation and the perpendicular line comprises between forty five and ninety degrees of arc.

* * * * *